US005498197A

United States Patent [19]

Roberts et al.

[11] Patent Number: 5,498,197

[45] Date of Patent: Mar. 12, 1996

[54] HAND-HELD BLAST CLEANING MACHINE

[75] Inventors: Jerry W. Roberts, Oklahoma City; James E. Riley; Richard L. Goswick, both of Tulsa; Scott T. Jednacz, Bixby, all of Okla.

[73] Assignee: Nelco Manufacturing Corp., Oklahoma City, Okla.

[21] Appl. No.: 152,644

[22] Filed: Nov. 12, 1993

Related U.S. Application Data

[63] Continuation-in-part of Ser. No. 86,284, Jul. 1, 1993, abandoned.

[51] Int. Cl.[6] ..... B24C 5/00

[52] U.S. Cl. ..... 451/94; 451/92; 451/95; 451/99; 451/354

[58] Field of Search ..... 451/92, 344, 350, 451/354, 94, 95, 97, 99

[56] References Cited

U.S. PATENT DOCUMENTS

| | | | |
|---|---|---|---|
| 923,100 | 5/1909 | Young . | |
| 2,204,610 | 6/1940 | Minich et al. | 51/9 |
| 2,254,234 | 9/1941 | Minich | 51/9 |
| 2,341,560 | 2/1944 | Keeper | 51/432 |
| 2,723,498 | 11/1955 | Hastrup et al. | 51/8 |
| 3,034,262 | 5/1962 | Pawlson | 51/9 |
| 3,368,308 | 2/1968 | Physioc, III | 51/432 |
| 3,827,188 | 8/1974 | Fuma et al. | 451/94 |
| 3,900,969 | 8/1975 | Diehn | 51/9 M |
| 3,906,673 | 9/1975 | Goto et al. | 51/9 M |
| 4,020,590 | 5/1977 | Bergh | 51/425 |
| 4,020,596 | 5/1977 | Bergh | 51/9 M |
| 4,057,938 | 11/1977 | Rohlfs | 51/432 |
| 4,165,586 | 8/1979 | Fricke | 51/432 |
| 4,242,844 | 1/1981 | Tucker | 51/432 |
| 4,364,823 | 12/1982 | Goff | 209/135 |
| 4,416,092 | 11/1983 | Nelson | 51/425 |
| 5,181,349 | 1/1993 | Schaffer | 51/170 R |

FOREIGN PATENT DOCUMENTS

| | | | |
|---|---|---|---|
| 0032161 | 7/1981 | European Pat. Off. | B24C 3/06 |
| 1121970 | 4/1960 | Germany . | |
| 632695 | 10/1982 | Switzerland . | |
| 1381685 | 1/1975 | United Kingdom . | |
| 2203368 | 10/1988 | United Kingdom | B24C 5/00 |

*Primary Examiner*—Maurina T. Rachuba
*Attorney, Agent, or Firm*—Dunlap & Codding

[57] ABSTRACT

A hand-held blast cleaning machine having a motor which serves as a handle. The machine includes a blast assembly for propelling abrasive material against a surface and a hopper for supplying abrasive material to the blast assembly. The blast assembly has a blast corridor, a rebound corridor, a blast opening, a blast wheel and a motor. The motor drives the rotation of the blast wheel and serves as a handle. The hopper has a return corridor, a collection area, a feed area and a vacuum conduit. The vacuum conduit is connected to a vacuum source to collect dust and debris from the blast cleaning operation. In one embodiment, an side-blast hopper, a down-blast hopper, an up-blast hopper and a side-feed hopper are all interchangeably attachable to the same blast assembly. A shut-off handle is attached to the blast assembly to provide automatic shut-off abrasive material to the blast wheel and to function as a second handle. In another embodiment, the motor serves as the only handle. A linear actuator connected to a feed valve in the hopper provides automatic shut-off of abrasive material to the blast wheel.

4 Claims, 6 Drawing Sheets

HAND-HELD BLAST CLEANING MACHINE

CROSS-REFERENCE TO RELATED APPLICATIONS

This application is a continuation-in-part of U.S. application Ser. No. 08/086,284, filed Jul. 1, 1993, and entitled "Hand-Held Blast Cleaning Machine, now abandoned."

BACKGROUND OF THE INVENTION

1. Field of the Invention

The present invention relates generally to blast cleaning machines, and particularly to, but not by way of limitation, to hand-held blast cleaning machines.

2. Description of Related Art

Various machines for blast cleaning surfaces are known in the art. For example, U.S. Pat. No. 3,034,262 issued to Pawlson discloses a resurfacing and finishing machine. The Pawlson machine has no mechanism for automatically blocking the flow of abrasive material when the machine is intentionally or accidentally released. Moreover, the Pawlson machine has no air wash for removing dust and debris from the abrasive material.

Another example is U.S. Pat. No. 3,900,969, issued to Diehn and disclosing a portable apparatus for blast cleaning. The Diehn apparatus is not designed to be hand-held. In fact, it is so unwieldy that it is supported on casters. In addition, the Diehn apparatus may only be used on surfaces which are somewhat vertically disposed in order for the hopper to gravity feed abrasive material to the blast wheel.

A third example of related art is U. S. Pat. No. 4,020,596, which is issued to Bergh and discloses a convertible blast cleaning unit. The Bergh unit has modules for converting the unit between side-blasting mode and up-blasting mode.

The Bergh unit is designed for cleaning large areas, such as the hulls of ships. Accordingly, the Bergh machine is not suitable for use as a hand-held device. Because only up-blasting and side-blasting are required for cleaning the hull of a ship, the Bergh unit is not designed for conversion to blast downward.

SUMMARY OF THE INVENTION

The present invention is a hand-held blast cleaning machine comprising a blast assembly and a hopper. The blast assembly has a blast opening and a blast corridor. A rotatable blast wheel is located in the blast corridor to propel abrasive material through the blast corridor and blast opening against a surface to be cleaned.

The hopper has a return corridor communicating with the blast opening to carry spent abrasive material back to the hopper for reuse. The hopper is positioned to gravity feed abrasive material to the blast wheel.

Drive means, such as an air motor or an electric motor, is operatively connected to the blast wheel to power the rotation of the blast wheel. The drive means is adapted to serve as a handle for the operator of the machine.

One object of the present invention is to provide a blast cleaning machine which can be completely supported and operated at the hands of one operator.

Another object of the present invention is to provide a blast cleaning machine which can be easily converted between side-blast, up-blast and down-blast modes.

Yet another object of the present invention is to provide a blast cleaning machine which collects dust and debris as the machine is operated.

Other objects, features and advantages of the present invention are apparent from the following detailed description when read in conjunction with the accompanying drawings and appended claims.

DETAILED DESCRIPTION OF THE PREFERRED EMBODIMENTS

Figure 1:
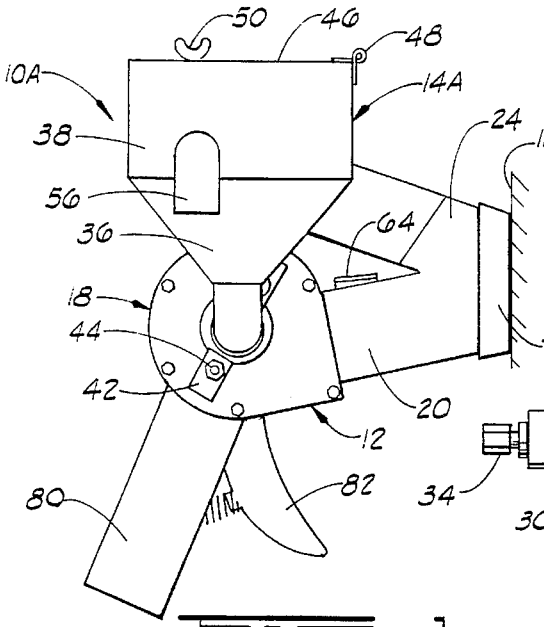
FIG. 1 is a side elevation of a hand-held blast cleaning machine constructed in accordance with the present invention and adapted for side-blasting.
Figure 2:
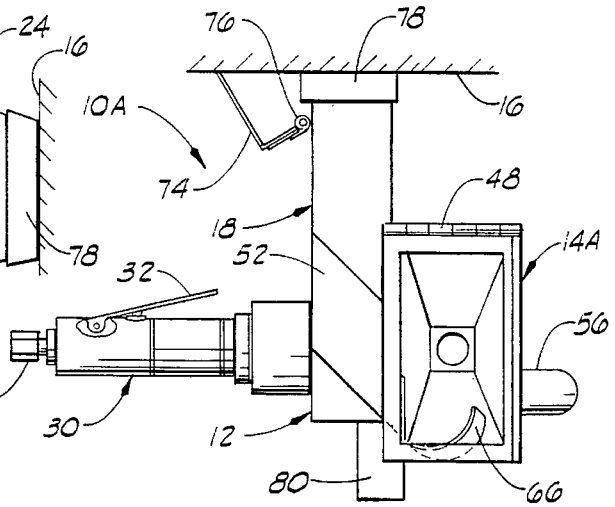
FIG. 2 is a top plan view of the machine of FIG. 1. The cover of the hopper is not shown to illustrate the interior of the hopper.
Figure 3:
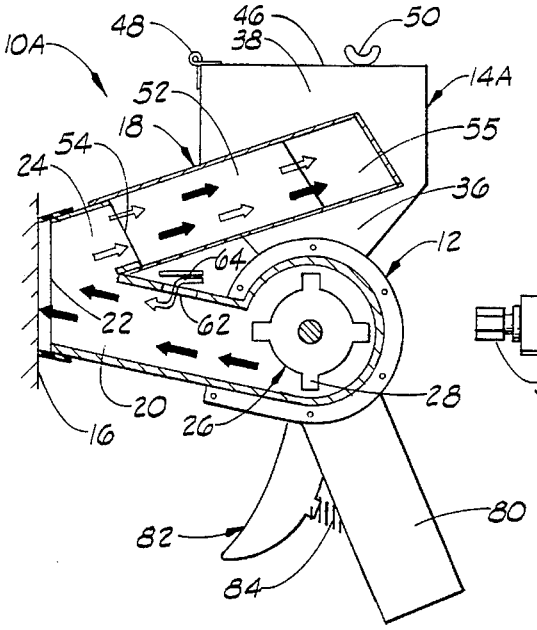
FIG. 3 is partly sectional, partly diagrammatical side view of the machine of FIG. 1. This view is from the side opposite to that of FIG. 1.

Referring to the drawings in general, and to FIGS. 1 through 4 in particular, shown therein and designated by the general reference numeral 10A is a hand-held blast cleaning machine, which includes a blast assembly 12 and a hopper 14A. As best shown in FIGS. 1 and 3, the machine 10 is designed for gravity feeding abrasive material from the hopper 14A into the blast assembly 12 to blast clean a vertically disposed surface 16.

The blast assembly 12 comprises a blast housing 18, which defines a blast corridor 20, a blast opening 22 and a rebound corridor 24. The blast housing 18 also has a supply opening 25 for passage of abrasive material into the blast housing 18. A blast wheel 26 is rotatably mounted in the blast housing 18 to propel abrasive material through the blast corridor 20 and blast opening 22 against the surface 16 to be cleaned.

Figure 4:
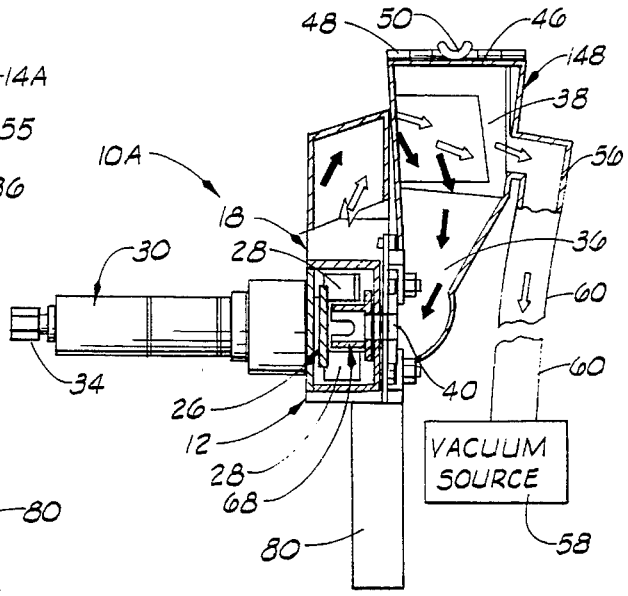
FIG. 4 is a partly sectional, partly diagrammatical end view of the machine of FIG. 1.

As illustrated by FIGS. 3 and 4, the blast wheel 26 is basically a circular plate having a plurality of radially extending blades. One of the blades is designated by reference numeral 28 and is generally representative of the blades of the blast wheel 26.

The blast wheel 26 is connected to a motor 30 to drive the rotation of the blast wheel 26. As illustrated by FIG. 2, the motor 30 includes an on/off switch 32 and a connector 34 for attaching the motor 30 to a power source (not shown). It should be appreciated that the motor 30 serves as a handle to be grasped by a person operating the machine 10A.

It should be appreciated that any suitable means for driving the rotation of the blast wheel 26 may be utilized with the machine 10. For example, the motor 30 may be an air motor, an electric motor, or any other type of motor capable of rotating the blast wheel 26.

The hopper 14A is provided to supply abrasive material to the blast wheel 26. The hopper 14A has a feed area 36 and a collection area 38. As best shown in FIG. 4, the feed area 36 of the hopper 14A has a feed opening 40 which communicates with the supply opening 25 of the blast housing 18.

As best shown in FIG. 1, the hopper 14A has a mounting plate 42 which is secured by a pair of lug nuts 44 screwed onto threaded lugs extending from the housing 18. This construction allows the hopper 14A to be easily unbolted from the housing 18 in order to change hoppers.

The hopper 14A also includes a lid 46 connected to the hopper 14A by a set of hinges 48. A suitable fastener 50 is provided to lock the lid 46 closed over the hopper 14A.

As best illustrated by FIGS. 2 and 3, the hopper 14A has a return corridor 52 which extends between the rebound corridor 24 of the blast housing 18 and the collection area 38 of the hopper 14A. The return corridor 52 has an inlet end 54 which is removably connected to the rebound corridor 24 and an outlet end 55 which is rigidly connected to the collection area 38 of the hopper 14A.

The return corridor 52 of the hopper 14A may be removably connected to the rebound corridor 24 of the housing 18 in a wide variety of ways. The return corridor 52 and the rebound corridor 24 may have ends which are sized and shaped so that the return corridor 52 may simply be slipped over or into the end of the rebound corridor 24. If desired, a strip of adhesive material such as duct tape may be wrapped around the connection of the return corridor 52 and the rebound corridor 24.

A vacuum conduit 56 communicates with the collection area 38 of the hopper 14A. As shown in FIG. 4, a vacuum source 58 is connected to the vacuum conduit 56 of the hopper 14A by a vacuum hose 60 to produce an air flow through the hopper 14A. As illustrated by FIG. 3, an air intake port 62 is provided through the blast housing 18. The air intake port 62 has an intake gate 64 which is adjustable to control the amount of air entering the air intake port 62.

The vacuum source 58 may be any suitable apparatus for drawing air through the machine 10A. Because the machine 10A has a size designed for hand-held operation, a conventional shop vacuum device with a five-gallon capacity is an acceptable vacuum source 58.

As best shown in FIG. 2, a deflector plate 66 is positioned in the collection area 38 of the hopper 14A. The deflector plate 66 is sized and shaped to direct abrasive material toward the feed area 36 of the hopper 14A and to allow dust, air and debris to be drawn out the vacuum conduit 56 to the vacuum source 58.

As mentioned previously, the feed opening 40 of the hopper 14A communicates with the supply opening 25 of the blast housing 18 to provide abrasive material to the blast wheel 26. As illustrated in greater detail by FIG. 6, abrasive material passes through the supply opening 25 of the blast housing 18 into a blast cage 68.

The blast cage 68 is basically a cylindrical tube which is open at both ends. One end of the blast cage 68 includes a collar 70 which is rigidly attached to the inner wall of the blast housing 18. The sidewall of the blast cage 68 has a blast aperture 72 therethrough. The blast cage 68 is mounted in the blast housing 18 with the blast aperture 72 positioned to direct abrasive material toward the blast opening 22 of the blast housing 18.

It should be appreciated that, except for the blast aperture 72, the sidewalls of the blast cage 68 are solid. Thus the abrasive material enters the interior of the blast cage 68 and travels through the blast aperture 72 to be propelled to the blast opening 22 by the blades 28 of the rotating blast wheel 26.

As shown in FIG. 2, a guard plate 74 is pivotally mounted to the housing 18 toward the blast opening 22. The guard plate 74 is sized and shaped to cover the blast opening 22 and is pivotable between an operating position (shown in FIG. 2) and a protective position, in which the guard plate 74 covers the blast opening 22.

A guard spring 76 is provided between the housing 18 and the guard plate 74 to bias the guard plate 74 into the protective position. With this construction, the guard plate 74 springs into the protective position as soon as the blast housing 18 is removed from the surface 16.

As shown in FIGS. 1 and 3, a blast seal 78 is attached to the blast housing 18 to surround the blast opening 22 and prevent the escape of abrasive material between the surface 16 and the blast housing 18. The blast seal 78 is typically made of an elastomeric material, but may be constructed of any suitably flexible material.

As best illustrated by FIGS. 1 and 3, a shut-off handle 80 is rigidly attached to the housing 18 and a shut-off trigger 82 is pivotally connected to the housing 18. A trigger spring 84 is located between the shut-off handle 80 and the shut-off trigger 82.

Figure 5:
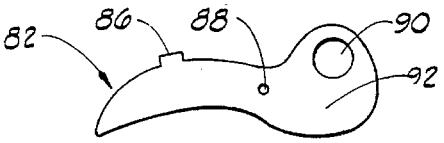
FIG. 5 is a side elevation of the automatic cut-off trigger of the machine of FIG. 1.

Referring now to FIG. 5, shown therein is the shut-off trigger 82, which has a mounting nub 86 for the trigger spring 84, a pivot hole 88, a flow opening 90 and a shut-off area 92. The shut-off trigger 82 is mounted to the housing 18 to pivot about the pivot hole 88 between an operating position and a shut-off position.

In the shut-off position, the shut-off area 92 of the shut-off trigger 82 is positioned between the feed opening 40 of the hopper 14A and the supply opening 25 of the blast housing 18 to prevent abrasive material from passing from the hopper 14A to the blast wheel 26. The trigger spring 84 biases the shut-off trigger 82 into the shut-off position.

In the operating position, the flow opening 90 of the shut-off trigger 82 is in communication with the feed opening 40 of the hopper 14A and the supply opening 25 of the blast housing 18 to allow passage of abrasive material from the hopper 14A to the blast wheel 26.

It should be appreciated that the bias of the trigger spring 84 must be overcome in order to pivot the shut-off trigger 82 into the operating position. Thus the shut-off trigger 82 automatically returns to the shut-off position and the flow of abrasive material to the blast wheel 26 is stopped when the shut-off trigger 82 is released by the operator of the machine 10A. If the machine 10A is dropped by the operator, the shut-off trigger 82 stops flow of abrasive material to the blast wheel 26 automatically and immediately to prevent injury or damage from errant blasting.

Figure 6:
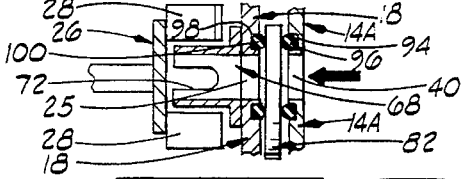
FIG. 6 is a partly diagrammatical, partly sectional view of the trigger of FIG. 5 mounted between the hopper O-ring seal and the housing O-ring seal.

As illustrated by FIG. 6, the outer wall of the hopper 14A has a circular hopper groove 94 around the feed opening 40. An elastomeric O-ring seal 96 is disposed in the groove 94. Similarly, the outer wall of the blast housing 18 has a circular housing groove 98 around the supply opening 25. An elastomeric O-ring seal 100 is disposed in the housing groove 98.

The shut-off trigger 82 is mounted between the hopper seal 96 and the housing seal 100. The hopper seal 96 engages one side of the shut-off trigger 82 and the housing seal 100 engages the other side of the shut-off trigger 82. With this construction, the hopper seal 96 prevents prevent leakage of abrasive material between the hopper 14A and the shut-off trigger 82, while the housing seal 100 keeps abrasive material from escaping between the housing 18 and the shut-off trigger 82.

Operation

In setting up the machine 10A for operation, abrasive material of the desired size is placed in the hopper 14A and the hopper lid 46 is closed and fastened. The motor 30 is connected to an appropriate power source. If the motor 30 is an air motor, for example, it is operatively connected to a suitable air compressor. The vacuum conduit 56 is connected to the vacuum source 58 by means of the vacuum hose 60 and the vacuum source 58 is switched on.

The hand-held operation of the machine 10 is best shown in FIG. 2. Gripping the shut-off handle 80 with the right hand, the operator opens the protective guard plate 74 with the left hand and then disposes the blast seal 78 against the surface 16 to be blast cleaned. The surface 16 holds the protective guard 74 away to expose the blast opening 22 to the surface 16.

The operator then moves the left hand to the motor 30 and squeezes the motor switch 32 on to drive the rotation of the blast wheel 26. Finally, the operator squeezes the shut-off trigger 82 with the right hand to move the shut-off trigger 82 into the operating position. Abrasive material passes from the hopper 14A to the blast wheel 26 to blast clean the surface 16. Gripping the machine 10A by the motor 30 and the shut-off handle 80, the operator moves the machine 10A over the surface 16.

The path of air and abrasive material through the machine 10A is best understood with reference to FIGS. 3 and 4. In these figures, abrasive material is indicated by solid arrows. Hollow arrows designate air and dust and debris entrained in the air flow.

Beginning with FIG. 4, abrasive material gravity feeds from the hopper 14A through the feed opening 40 and the supply opening 25 into the blast cage 68. Abrasive material passes through the blast aperture 72 of the blast cage 68 to be propelled by the blades 28 of the blast wheel 26.

As shown in FIG. 3, abrasive material is propelled through the blast corridor 20 and blast opening 22 against the surface 16. The blast seal 78 prevents escape of abrasive material between the blast housing 18 and the surface 16.

After striking the surface 16, the abrasive material bounces into the rebound corridor 24. Meanwhile, the vacuum source 58 draws air into the blast corridor 20 through the air intake port 62 and pulls air, abrasive material, dust and debris through the return corridor 52 into the collection area 38 of the hopper 14A.

As illustrated by FIG. 4, air, abrasive material, dust and debris enter the collection area 38 of the hopper 14A together. The abrasive material, directed by the deflection plate 66, falls by gravity into the feed area 36 of the hopper 14A. Air, dust and debris, however, are drawn into through the vacuum conduit 56 and vacuum hose 60 into the vacuum source 58.

The machine 10A should be shut down by first releasing the shut-off trigger 82. The trigger spring 84 automatically moves the shut-off trigger 82 to the shut-off position to stop flow of abrasive material to the blast wheel 26. Then the motor 30 and vacuum source 58 are turned off.

Embodiments of FIGS. 7 through 11

Referring now to FIGS. 7 through 11, shown therein and designated by reference character 10B is an alternate embodiment of the hand-held blast cleaning machine. This particular embodiment is adapted for downward blast cleaning a substantially horizontal surface, such as a floor.

The machine 10B comprises the blast assembly 12 and a down-blast hopper 14B. It should be appreciated that the blast assembly utilized in the machine 10B is identical to that described hereinabove and used with the hand-held side-blast machine 10A.

Figure 7:
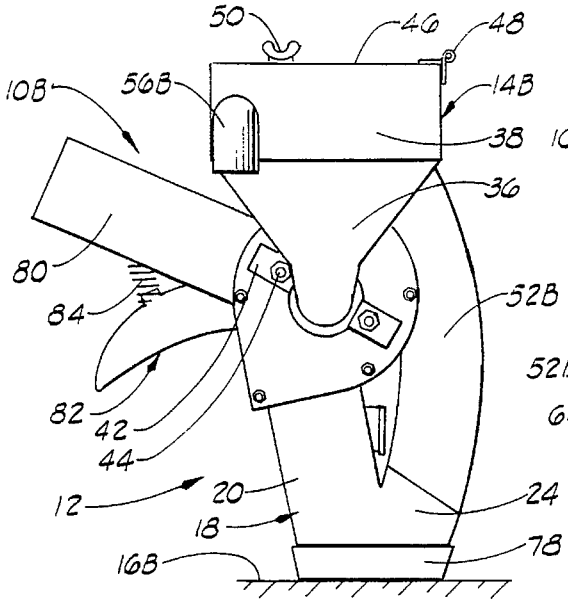
FIG. 7 is a side elevation of a hand-held blast cleaning machine constructed in accordance with the present invention and adapted for down-blasting.
Figure 8:
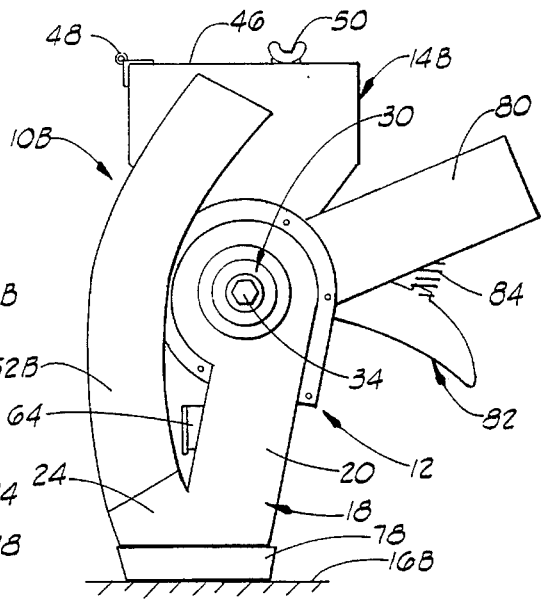
FIG. 8 is a side elevation of the machine of FIG. 7. This view shows the side opposite from that shown in FIG. 7.
Figure 9:
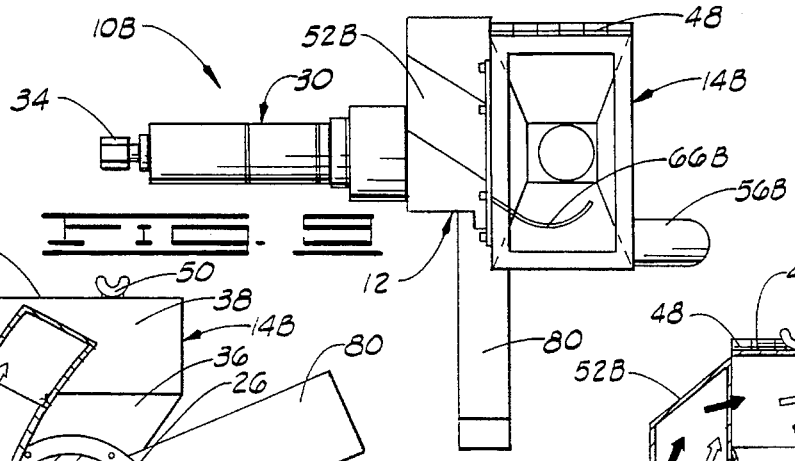
FIG. 9 is a top plan view of the machine of FIG. 7. The cover of the hopper is not shown in order to illustrate the interior of the hopper.

The down-blast hopper 14B is very similar to the side-blast hopper 14A, but differs in some respects. As shown in FIGS. 7 through 9, the down-blast hopper 14B has a return corridor 52B which is curved and enters at a medial portion of the collection area 38 of the down-blast hopper 14B.

As illustrated by FIG. 9, the down-blast hopper 14B has a deflection plate 66B and a vacuum conduit 56B which are in positions different from those of the side-blast hopper 14A. The different positions of the deflection plate 66B and the vacuum conduit 56B are designed to direct abrasive material into the feed area 36 of the down-blast hopper 14B and to draw dust and debris into the vacuum source 58.

The construction of the down-blast hopper 14B is designed for gravity feed of abrasive material from the down-blast hopper 14B to the blast wheel 26 with the blast opening 22 oriented downward against a substantially horizontal surface 16B.

Figure 11:
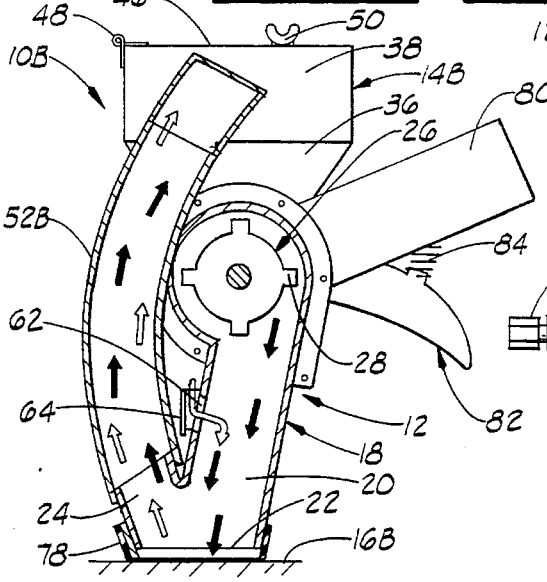
FIG. 11 is the same view as FIG. 8, but is partly diagrammatical and partly sectional. The solid arrows indicate the path of abrasive material and the hollow arrows indicate the path of air, dust and debris.
Figure 10:
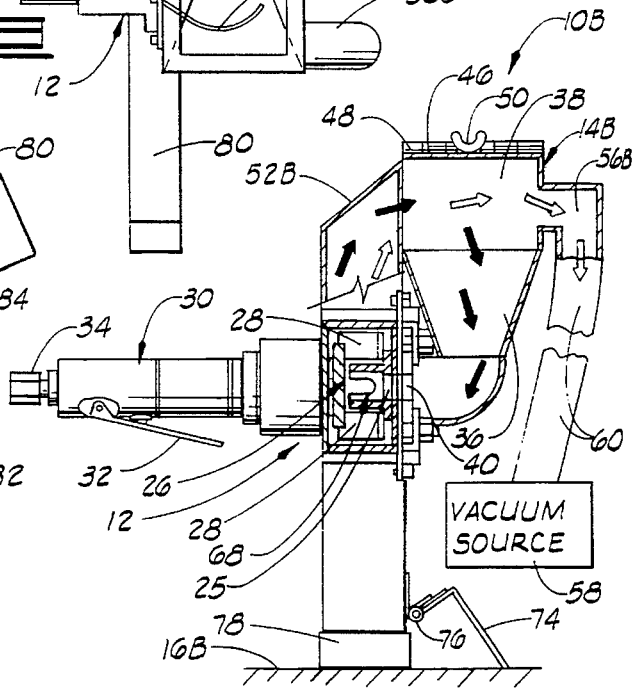
FIG. 10 is a partly diagrammatical, partly sectional end view of the machine of FIG. 7. The solid arrows indicate the path of abrasive material and the hollow arrows indicate the path of air, dust and debris.

The paths of abrasive material, air, dust and debris are illustrated by FIGS. 10 and 11. The path of abrasive material is indicated by solid arrows, while the path of air, dust and debris is designated by hollow arrows.

It should be appreciated that the same blast assembly 12 may be used as a hand-held side-blast machine 10A with the side-blast hopper 14A or as a hand-held down-blast machine 10B with the down-blast hopper 14B. The change in hoppers is made by removing the nuts 44 securing one hopper 14A or 14B to the housing 18 and removing the return corridor 52A or 52B from the rebound corridor 24. The other hopper 14A or 14B is attached to the housing 18 simply by connecting the return corridor 52A or 52B to the rebound corridor 24 and securing the hopper 14A or 14B in place with the lug nuts 44.

It should be understood that the set up and operation of the hand-held blast cleaning machine 10B are substantially the same as those described hereinabove for the machine 10A. The machine 10B gravity feeds abrasive material for blasting downward, while the machine 10A gravity feeds abrasive material for blasting sideways.

Embodiment of FIGS. 12 through 15

With reference now to FIGS. 12 through 15, shown therein and designated by reference character 10C is yet another embodiment of the hand-held blast cleaning machine. The machine 10C is adapted for up-blasting a substantially horizontal surface 16C, such a ceiling.

The machine 10C comprises the blast assembly 12 and an up-blast hopper 14C. The blast assembly 12 is identical to that described hereinabove for the machines 10A and 10B.

Figure 14:
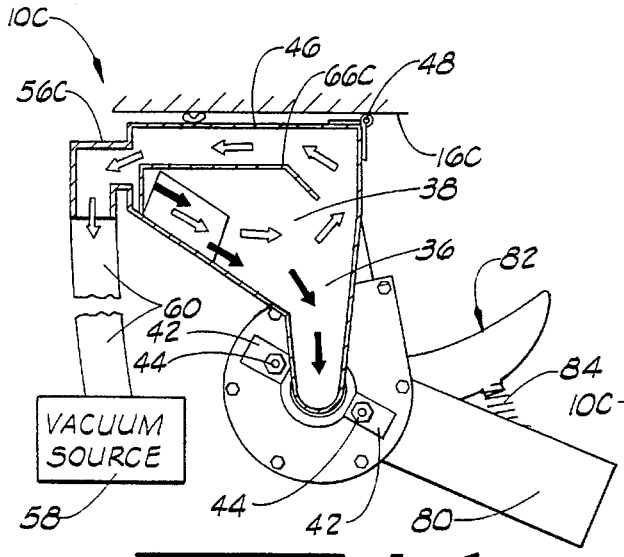
FIG. 14 is a partly diagrammatical, partly sectional side view of the machine of FIG. 12.

As shown in FIG. 14, the up-blast hopper 14C has a somewhat different shape from the side-blast hopper 14A and the down-blast hopper 14B. The up-blast hopper 14C has a vacuum conduit 56C which communicates into the end wall 102 of the up-blast hopper 14C opposite from the shut-off handle 80. In addition, the up-blast hopper 14C has a deflector plate 66C which extends from the end wall 102 and angles toward the feed area 36 to direct abrasive material into the feed area 36 of the up-blast hopper 14C.

Figure 12:
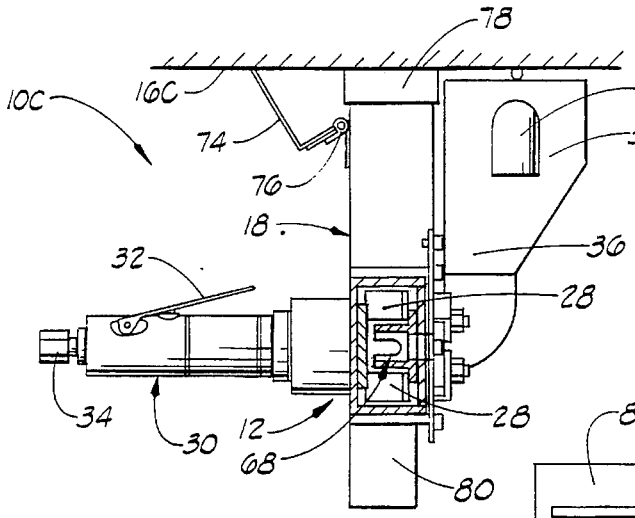
FIG. 12 is a partly sectional end view of a hand-held blast cleaning machine constructed in accordance with the present invention and adapted for up-blasting.
Figure 13:
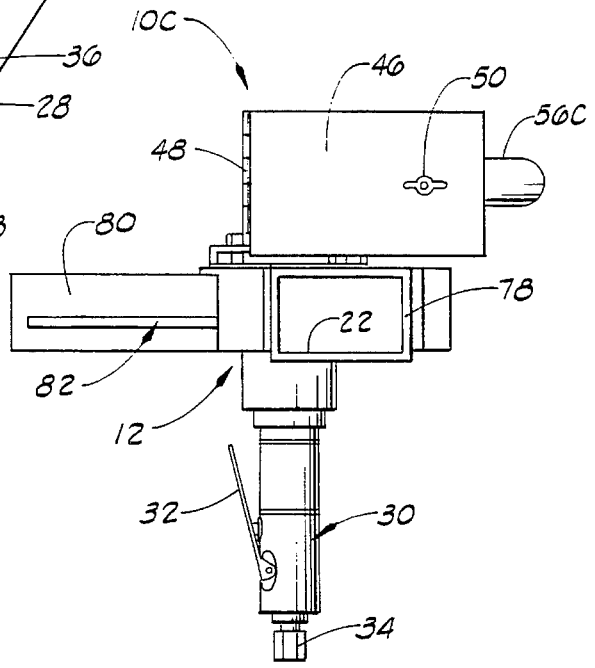
FIG. 13 is a top plan view of the machine of FIG. 12.
Figure 15:
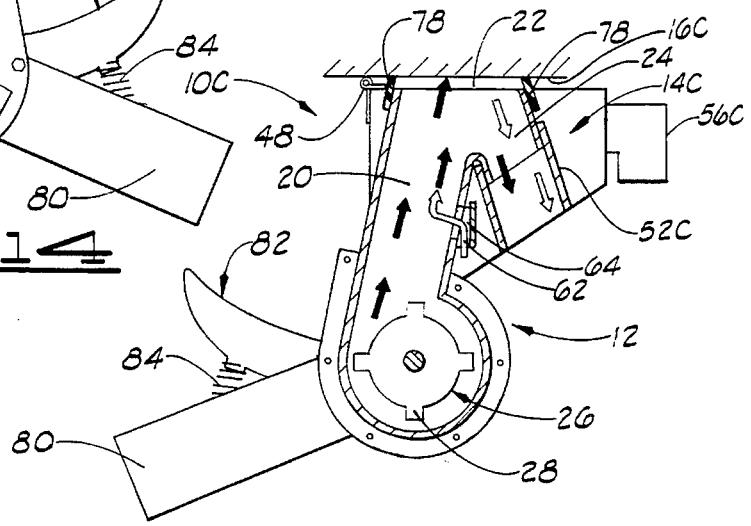
FIG. 15 is a partly diagrammatical, partly sectional side view of the machine of FIG. 12. This view shows the side opposite from that shown in FIG. 14.

As illustrated by FIGS. 12 and 15, the lid 46 of the up-blast hopper 14C is nearly coplanar with the blast opening 22. Accordingly, the up-blast hopper 14C has a short return corridor 52 connecting the rebound corridor 24 to the collection area 38, as shown in FIGS. 14 and 15.

It should be appreciated that the up-blast hopper 14C is readily detachable from the blast assembly 12 and is interchangeable with the side-blast hopper 14A and the down-blast hopper 10B. The set-up, operation and shut-down of the machine 10C is substantially the same as the set-up, operation and shut-down of the machines 10A and 10B described hereinabove. The up-blast hopper 14C is disconnected from and re-attached to the blast assembly 12 in substantially the same manner as described hereinabove for the side-blast hopper 14A and the down-blast hopper 14B.

Figure 16:
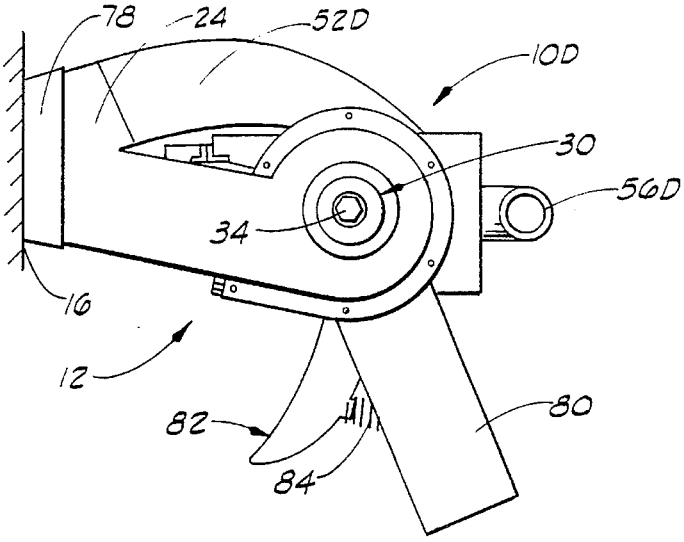
FIG. 16 is a side elevation of an alternate embodiment of a hand-held blast cleaning machine constructed in accordance with the present invention for side-blasting.
Figure 17:
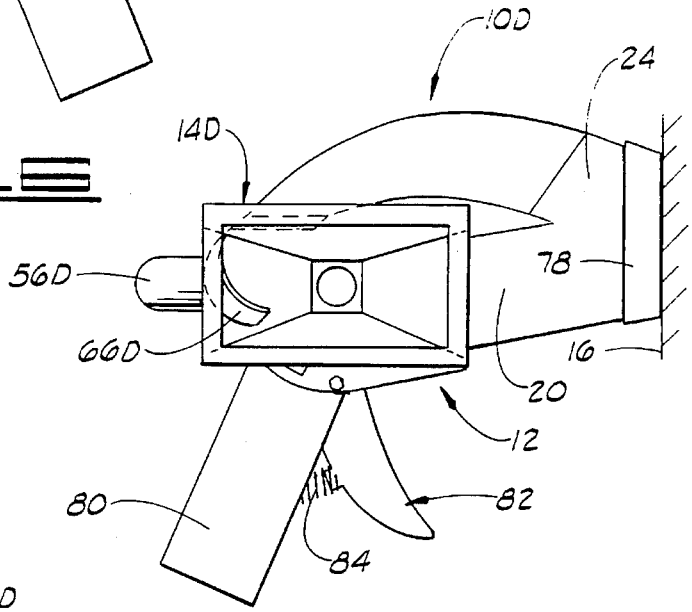
FIG. 17 is a side view of the machine of FIG. 16. This view shows the side opposite from that shown in FIG. 16. The cover of the hopper is not shown to illustrate the interior of the hopper.
Figure 18:
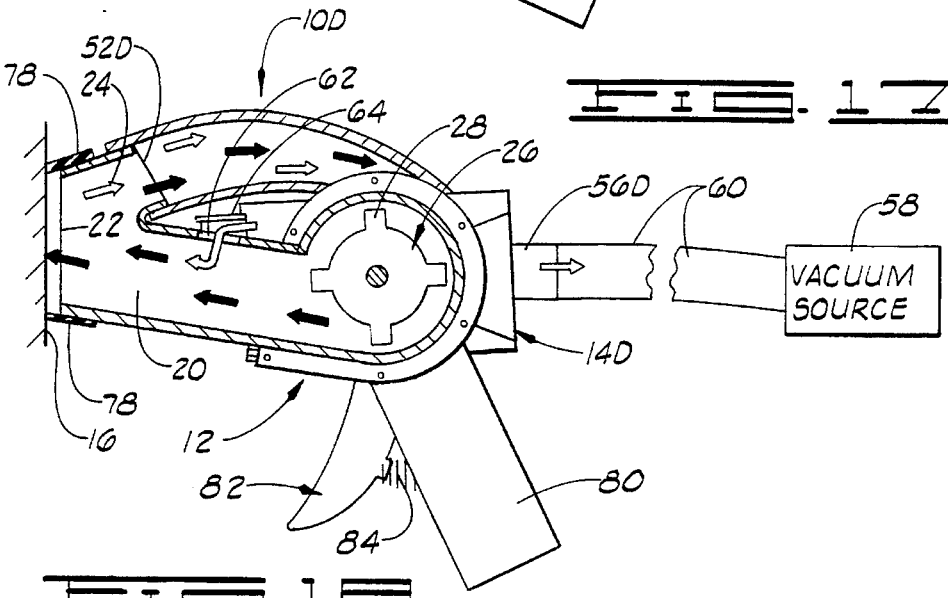
FIG. 18 is the same view as FIG. 16, but is partly diagrammatical and partly sectional. The solid arrows indicate the path of abrasive material and the hollow arrows indicate the path of air, dust and debris.

Embodiment of FIGS. 16 through 18

Referring now to FIGS. 16 through 18, shown therein and designated by reference character 10D is yet another embodiment of the hand-held blast cleaning machine. The machine 10D is adapted to side-blast a substantially vertical surface 16D and to side-feed abrasive material to the blast wheel 26.

The machine 10D includes the blast assembly 12 and a side-feed hopper 14D. The blast assembly 12 is identical to that described hereinabove for the machines 10A, 10B and 10C.

As shown in FIG. 17, the side-feed hopper 14D has a vacuum conduit 56D which communicates into the side-feed hopper 14D through an end wall 104 opposite from the blast opening 22. In addition, the side-feed hopper 14D has a curved deflector plate 66D positioned to direct abrasive material toward the feed opening 40 of the side-feed hopper 14D.

In the machines 10A, 10B and 10C previously described, the hoppers 14A, 14B and 14C gravity feed abrasive material. In contrast, the machine 10D feeds abrasive material laterally. As illustrated by FIGS. 17 and 18, abrasive material moves from the hopper 14D along a substantially horizontal straight line rather than gravity feeding downward and turning into the blast housing 18.

Accordingly, the machine 10D depends more on air flow to move the abrasive material from the side-feed hopper 14D to the blast wheel 26. In order to enhance the air flow, the side-feed hopper 14D has a return corridor 52D with a diminishing cross-sectional area. By reducing the cross-sectional area of the return corridor 52D from the rebound corridor 24 toward the side-feed hopper 14D, the air velocity is increased through the diminishing cross-sectional area.

It should be appreciated that the side-feed hopper 14D is readily detachable from the blast assembly 12 and is interchangeable with the side-blast hopper 14A, the down-blast hopper 14B and the up-blast hopper 14C. The set-up, operation and shut-down of the machine 10D is substantially the same as the set-up, operation and shut-down of the machines 10A, 10B and 10C described hereinabove. The side-feed hopper 14D is disconnected from and re-attached to the blast assembly 12 in substantially the same manner as described hereinabove for the side-blast hopper 14A, the down-blast hopper 14B and the up-blast hopper 14C.

Figure 19:
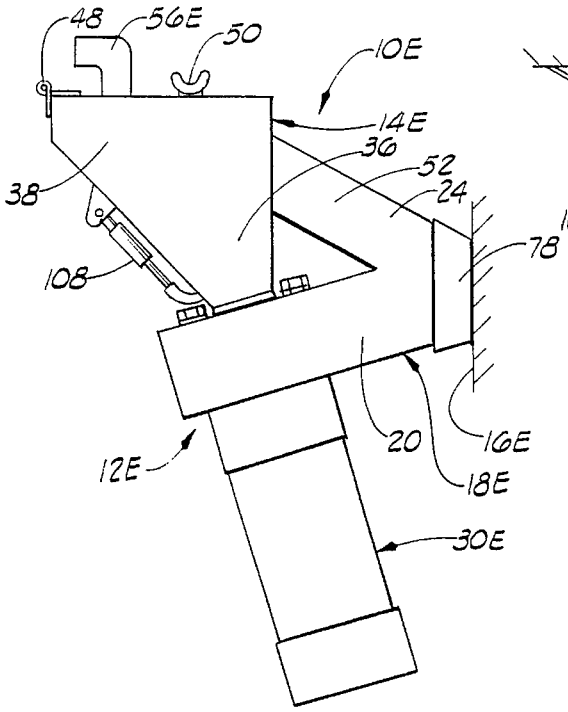
FIG. 19 is a side elevation of another embodiment of a hand-held blast cleaning machine constructed in accordance with the present invention for side-blasting.
Figure 20:
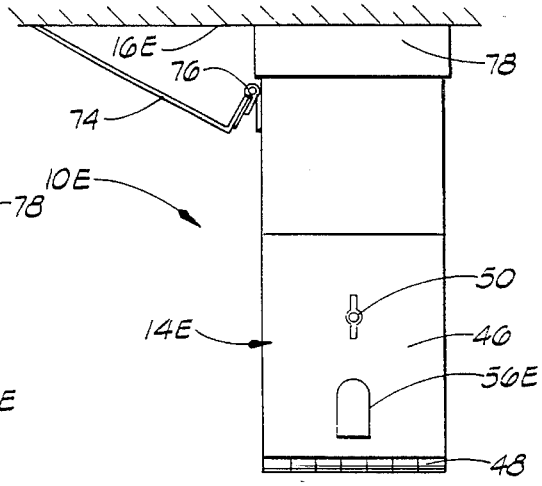
FIG. 20 is a top plan view of the machine of FIG. 19.
Figure 21:
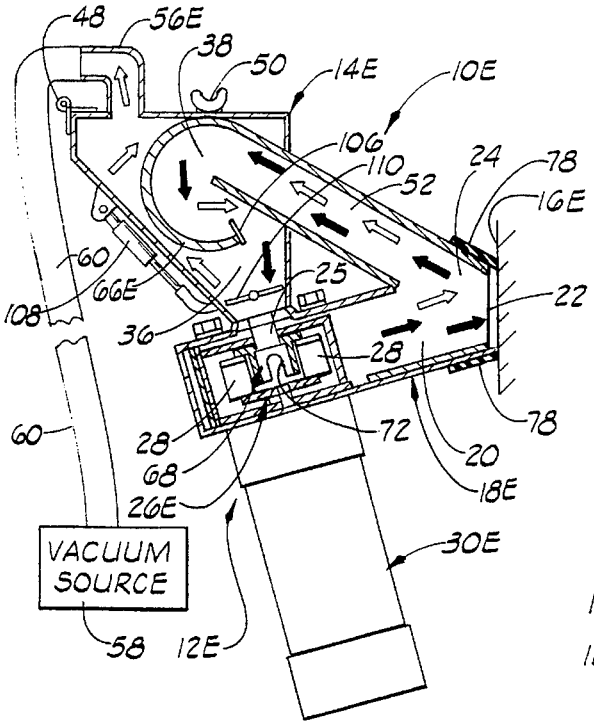
FIG. 21 is the same view as FIG. 19, but is partly diagrammatical and partly sectional. The solid arrows indicate the path of abrasive material and the hollow arrows indicate the path of air, dust and debris.

Embodiment of FIGS. 19 through 21

Turning now to FIGS. 19 through 21, shown therein and designated by reference character 10E is another embodiment of the hand-held blast cleaning machine. The machine 10E is particularly adapted to be held by one hand to blast clean a substantially vertical surface 16E.

The machine 10E comprises a modified blast assembly 12E and hopper 14E. The blast assembly 12E includes the housing 18E, the blast wheel 26E, blast cage 68 with the blast aperture 72, the blast corridor 20, the blast opening 22, the blast seal 78 and the rebound corridor 24.

As illustrated by FIG. 21, the hopper 14E of machine 10E is located over the blast wheel 26E and the outer edges of the blades 28 of the blast wheel 26E extend in top-to-bottom fashion in the blast corridor 20. In the embodiments described hereinabove, the hopper 14A, 14B, 14C or 14D is to the side of the blast wheel 26 and the outer edges of the blades 28 extend in side-to-side manner in the blast corridor 20. As shown in FIG. 20, mounting the hopper 14E over the blast wheel 26E makes the machine 10E a more compact unit than the machines 10A, 10B, 10C and 10D.

A one-half horsepower electric motor 30E is typically mounted to the machine 10E to drive the rotation of the blast wheel 26E. It should be appreciated that motors with a wide variety of sizes, shapes and horsepower ratings may be used for the electric motor 30E. It should also be understood that a pneumatic drive or any other suitable power drive may be utilized to rotate the blast wheel 26E.

It is important to note that the motor 30E is sized and shaped to serve as a handle for the machine 10E. Furthermore, the machine 10E is sufficiently small and light that the motor 30E may be grasped with one hand to support and operate the machine 10E.

The hopper 14E includes the lid 46E with hinges 48 and fastener 50 and defines the return corridor 52, the collection area 38 and the feed area 36. In addition, the hopper 14E has a vacuum conduit 56E which communicates with the collection area 38 of the hopper 14E through the lid 46E. As in other embodiments described hereinabove, the vacuum conduit 56E is connected to the vacuum source 58 with the vacuum hose 60.

As illustrated by FIG. 21, a curved deflector plate 66E extends across the interior of the hopper 14E to direct abrasive material, air, dust and debris toward the feed area 36 of the hopper 14E. The edge of the deflector plate 66E has a lip 106 which causes an accumulation of abrasive material in the curvature of the deflector plate 66E.

As best understood by referring to FIGS. 19 and 21, a linear actuator 108 is attached to the housing 18E and is operatively connected to a feed valve 110 mounted in the feed area 36 of the hopper 14E. The feed valve 110 is adapted to be moved by the linear actuator 108 between an operating position and a shut-off position.

In the operating position, the feed valve 110 allows abrasive material to pass from the feed area 36 of the hopper 14E to the blast wheel 26E. In the shut-off position, the feed valve 110 prevents the passage of abrasive material from the hopper 14E to the blast wheel 26E.

Various types of linear actuators 108 and feed valves 110 may be utilized in the machine 10E. A conventional butterfly valve may be used for the feed valve 110. An acceptable linear actuator 108 is commercially available from Warner Electric in Marnego, Ill.

In FIG. 21, the path of abrasive material is indicated by solid arrows and the path of air, dust and debris is designated by hollow arrows. Abrasive material is propelled by the blades 28 of the blast wheel 26E through the blast corridor 20 and blast opening 22 against the surface 16E. Striking the surface 16E, the abrasive material caroms into the rebound corridor 24 and is drawn by the air flow from the vacuum source 58 into the collection area 38 of the hopper 14E.

Once in the collection area 38 of the hopper 14E, the abrasive material accumulates in the curvature of the deflector plate 66E until it spills over the lip 106 of the deflector plate 66E into the feed area 36 of the hopper 14E. The abrasive material eventually passes from the feed area 36 of the hopper 14E into the blast cage 68 to be propelled against the surface 16E again.

As illustrated by FIG. 21, air is drawn through the blast corridor 20, the rebound corridor 24, the return corridor 52, the hopper 14E, the vacuum conduit 56E and the vacuum hose 60 into the vacuum source 58. Dust and debris travel with the air and are collected in the vacuum source 58.

Figure 22:
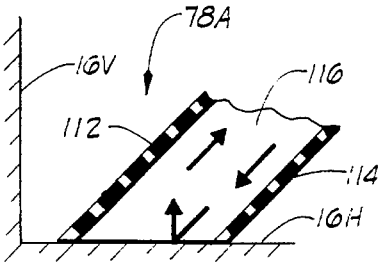
FIG. 22 is a partly sectional, partly diagrammatical side view of a skirt angled to direct abrasive material against a horizontal surface proximate to an adjoining vertical surface.
Figure 23:
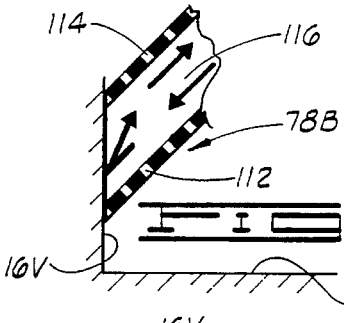
FIG. 23 is a partly sectional, partly diagrammatical side view of a skirt angled to direct abrasive material against a vertical surface proximate to an adjoining horizontal surface.
Figure 24:
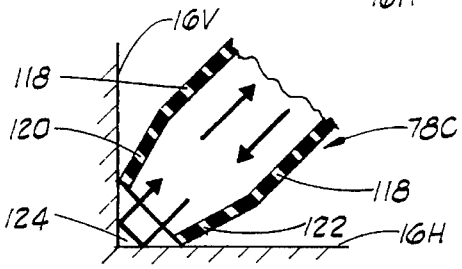
FIG. 24 is a partly sectional, partly diagrammatical side view of a skirt angled to direct abrasive material into the juncture of adjoining horizontal and vertical surfaces.

Embodiment of FIGS. 22 through 24

As described hereinabove, the blast seal 78 has sides which extend straightly and evenly to the surface to be blast cleaned. This construction of the blast seal 78 is not particularly suited for reaching a surface near an adjoining surface. For example, the blast seal 78 cannot be readily disposed against a wall next to the ceiling.

In order to blast clean such hard-to-reach areas, the blast seal 78 is adapted to be detachable from the housing 18 or 18E and several versions of the blast seal 78 are provided. One such version of the blast seal is designated by reference character 78A in FIG. 22. The blast seal 78A has a long wall 112, an opposite short wall 114 and two opposing parallelogram-shaped walls 116. Only one of the parallelogram-shaped walls 116 is visible in the sectional view of FIG. 22.

With this construction, the blast seal 78A extends angularly to seal against a surface 16H near an adjoining surface 16V. The blast seal 78A is particularly suited for cleaning a substantially horizontal surface 16H near an adjoining surface. As indicated by the solid arrows in FIG. 22, abrasive material travels through the blast seal 78A to strike the surface 16H and rebounds from the surface 16H back through the blast seal 78A.

Referring now to FIG. 23, shown therein and designated by reference character 78B is a blast seal adapted for blast cleaning the substantially vertical surface 16V near the adjoining surface 16H. The blast seal 78B is basically the same as the blast seal 78A, but flipped over. In fact, blast seals 78A and 78B may be the same blast seal, but attached to the housing 18 with opposite orientations.

With reference now to FIG. 24, shown therein and designated by reference character 78C is a blast seal adapted for blast cleaning into the juncture of two adjoining surfaces 16H and 16V. The blast seal 78C has opposing walls 118 having end portions 120 and 122 which angle inward toward one another. With this construction, abrasive material is directed into the juncture area 124 of the two surfaces 16H and 16V, as indicated by the solid arrows in FIG. 24.

The blast seals 78, 78A, 78B and 78C may be removably attached to the housing 18 of any of the machines described hereinabove in a wide variety of ways. For example, the blast seals 78, 78A, 78B and 78C may be attached by simply pulling them over the housing 18 around the blast opening 22.

The blast seals 78, 78A, 78B and 78C may be further secured by providing a groove (not shown) around the exterior of the housing 18 and a ridge (not shown) around the interior of the blast seal 78, 78A, 78B or 78C to mate with the groove. Conversely, the exterior of the housing 18 may have the ridge and the interior of the blast seal 78, 78A, 78B or 78C may have the mating groove.

To provide an even more secure attachment of the blast seal 78, 78A, 78B or 78C to the housing 18, adhesive tape or an adjustable strap (not shown) may be tightly placed around the blast seal 78, 78A, 78B or 78C.

Embodiment of FIGS. 25 through 28

Figure 25:
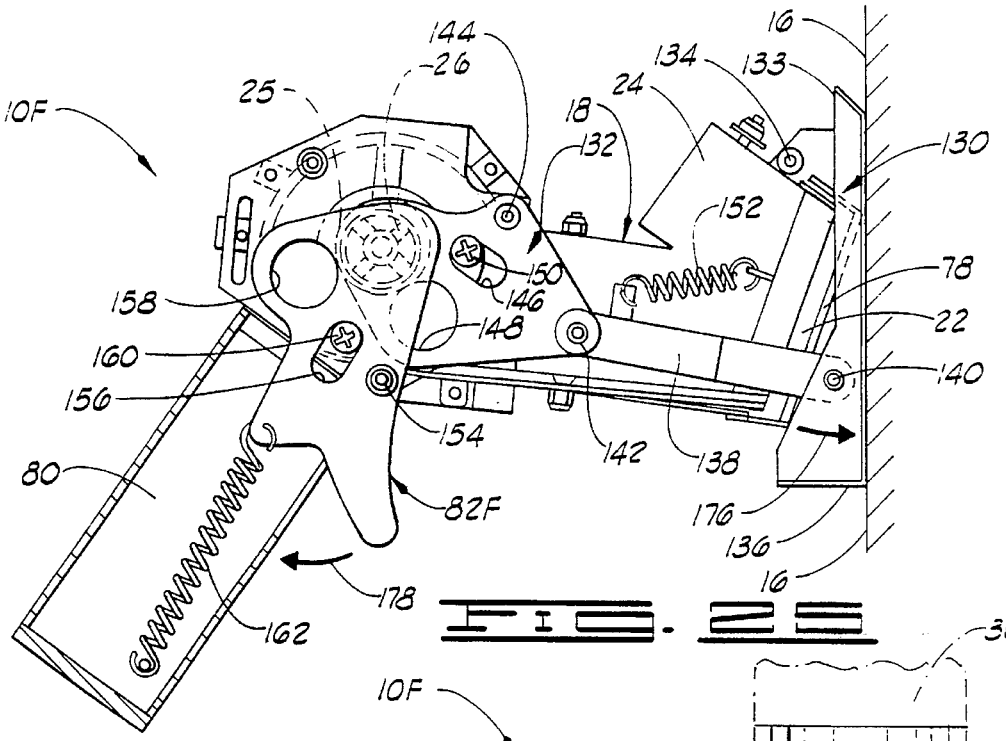
FIG. 25 is a partly sectional, partly diagrammatical side view of another hand-held blast cleaning machine constructed in accordance with the present invention. For simplicity of illustration a hopper and motor are not shown.
Figure 26:
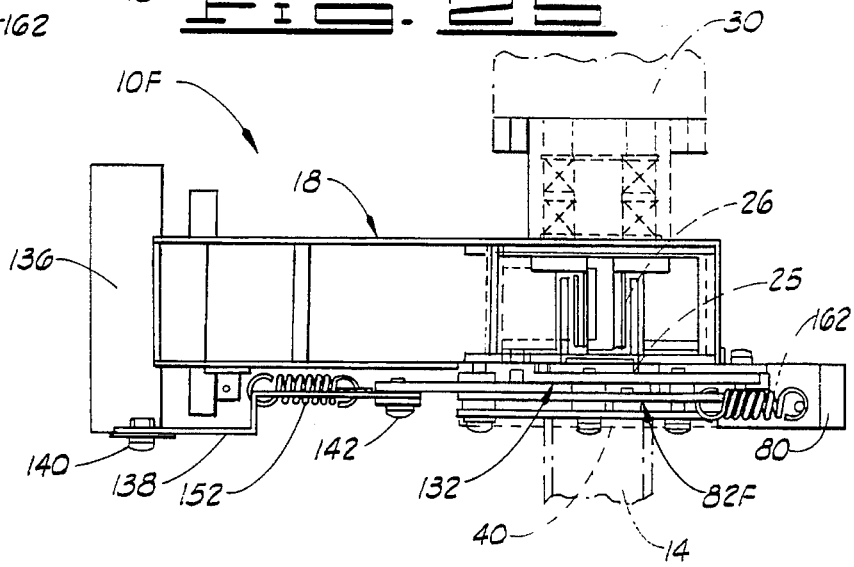
FIG. 26 is a bottom view of the blast cleaning machine of FIG. 25. The attachment of the hopper and motor are shown in phantom lines.

With reference now to FIGS. 25 and 26, shown therein and designated by reference character 10F is another embodiment of a hand-held blast machine constructed in accordance with the present invention. Although not shown in FIGS. 25 and 26 for simplicity of illustration, it should be appreciated that a hopper and motor are attached to the machine 10F during operation of the machine 10F.

The attachment of the motor 30 and hopper 14 to the machine 10F, however, is indicated in phantom lines in FIG. 26. As best seen in FIG. 25, the rebound corridor 24 is connected to the return corridor 52 of the hopper 14 in a manner described hereinabove for other embodiments of the machine.

The blast machine 10F includes a modified shut-off trigger 82F, a shoe 130 and a shut-off plate 132. Both the trigger 82F and the shut-off plate 132 are adapted to pivot between a shut-off position and a feed position.

In the feed position, the trigger 82F and the shut-off plate 132 allow abrasive material to pass from the hopper 14 to the blast wheel 26. In the shut-off position, the trigger 82F and the shut-off plate 132 both block the path of abrasive material between the feed opening 40 of the hopper 14 and the supply opening 25 to the blast wheel 26. Thus the blast machine 10F provides double automatic shut-off of the supply of abrasive material to the blast wheel 26.

The shoe 130 is sized and shaped to frame the blast opening 22 of the machine 10F. The upper end 133 of the shoe 130 is pivotally mounted to the housing 18 with a pivot pin 134. The lower end 136 of the shoe 130 is widened to cover the gap between the surface 16 and the seal 78 around the blast opening 22 when the shoe 130 is pivoted away from the housing 18.

The lower end 136 of the shoe 130 is pivotally connected to a link member 138 with a pivot pin 140. In turn, the opposite end of the link member 138 is pivotally connected to the shut-off plate 132 with a pivot pin 142.

The shut-off plate 132 is pivotally mounted to the housing with a pivot pin 144. Furthermore, the shut-off plate 132 is provided with a guide slot 146 and a feed opening 148. A guide nub 150 extends from the housing 18 and through the guide slot 146 to direct the pivoting movement of the shut-off plate 132.

In order to bias the shut-off plate 132 into a shut-off position, a biasing spring 152 is provided. One end of the biasing spring 152 is attached to the housing 18 and the opposite end of the biasing spring 152 is attached to the link member 138 near the pivot pin 142. In the shut-off position, the feed opening 148 of the shut-off plate 132 does not intersect with the supply opening 25 to the blast wheel 26.

Like the shut-off plate 132, the trigger 82F is pivotally mounted to the housing 18 with a pivot pin 154. The trigger 82F also has a guide slot 156 and a feed opening 158. A second guide nub 160 extends from the housing 18 and through the guide slot 156 to control the pivoting movement of the trigger 82F.

A trigger spring 162 is provided within the handle 80 to bias the trigger 82F into a shut-off position. In the shut-off position, the feed opening 158 of the trigger 82F does not intersect with the supply opening 25 to the blast wheel 26.

Figure 27:
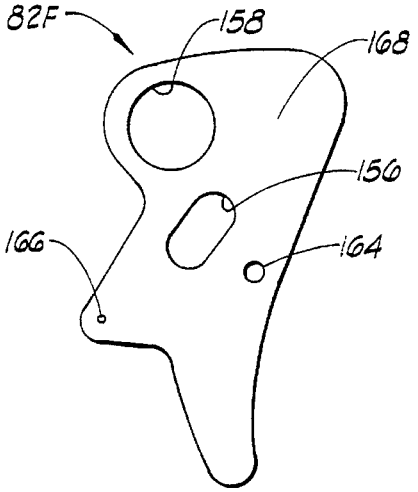
FIG. 27 is a view of the trigger of the blast cleaning machine shown in FIG. 25 from the same perspective as that of FIG. 25.

Referring to FIG. 27, shown therein is the trigger 82F separately. The trigger 82F has a pivot hole 164 for receiving the pivot pin 154 and a mounting hole 166 for the trigger spring 162.

As mentioned hereinabove, the trigger 82F has the feed opening 158 and the guide slot 156. The feed opening 158 of the trigger 82F should be substantially the same size and shape as the supply opening 25 to the blast wheel 26.

The trigger 82F also has a solid shut-off area 168. The shut-off area 168 should be large enough to completely block the supply opening 25 to the blast wheel 26 when the trigger 82F is in the shut-off position.

Figure 28:
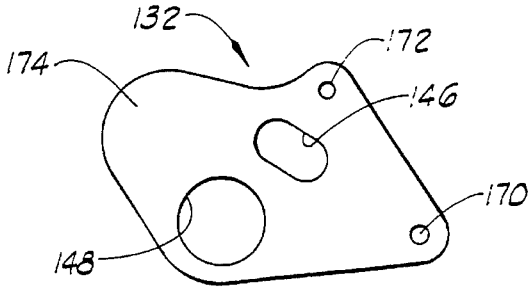
FIG. 28 is a view of the shut-off plate of the blast cleaning machine shown in FIG. 25 from the same perspective as that of FIG. 25.

With reference to FIG. 28, shown therein is the shut-off plate 132 separately. The shut-off plate 132 has a mounting hole 170 for pivotal connection to the link member 138 and another mounting hole 172 for mounting the shut-off plate 132 with the pivot pin 144 to the housing 18.

As described hereinabove, the shut-off plate 132 has the feed opening 148 and the guide slot 146. The feed opening 148 should be substantially the same size and shape as the supply opening 25 to the blast wheel 26.

Like the trigger 82F, the shut-off plate 132 has a shut-off area 174. The shut-off area 174 of the shut-off plate 132 should be large enough to completely block the supply opening 25 to the blast wheel 26 when the shut-off plate 132 is in the shut-off position.

The operation of the machine 10F is best understood with reference to FIG. 25. First, the machine 10F is positioned with the shoe 130 against the surface 16 to be blast-cleaned. The biasing spring 152 holds the shut-off plate 132 in the shut-off position and the trigger spring 162 biases the trigger 82F in the shut-off position. In this double shut-off position, both shut-off areas 168 and 174 are blocking the supply opening 25 to the blast wheel 26.

As indicated by direction arrow 176, the machine 10F is urged toward the surface 16 to dispose the blast opening 22 flush against the surface 16. This urging motion 176 overcomes the bias of the biasing spring 152.

By linking the shoe 130 and the shut-off plate 132, the link member 138 transfers the urging motion 176 into rotation of the shut-off plate 132 about the pivot pin 144. When the blast opening 22 is flush against the surface 16 in proper operating position, the shut-off plate 132 is rotated such that the feed opening 148 of the shut-off plate 132 is fully aligned with the supply opening 25 to the blast wheel 26.

The trigger 82F is then pivoted, as indicated by direction arrow 178, to overcome the bias of the trigger spring 162. Directed by the guide nub 160, the trigger 82F is rotated about the pivot pin 154 until the feed opening 158 of the trigger 82F is fully aligned with the supply opening 25 to the blast wheel 26.

When the feed opening 158 of the trigger 82F is fully aligned with the supply opening 25 to the blast wheel 26, the trigger 82F is in the full feed position. Of course, when the feed opening 158 of the trigger 82F is partially aligned with the supply opening 25 to the blast wheel 26, a smaller amount of abrasive material is fed to the blast wheel 26.

In order to feed abrasive material from the hopper 14 to the blast wheel 26, the feed openings 148 and 158 of both the shut-off plate 132 and the trigger 82F must be at least partially aligned with the supply opening 25 to the blast wheel 26. Accordingly, the machine 10F has a double safeguard against delivering abrasive material to the blast wheel 26 when the machine 10F is not in proper operating position.

All other aspects of the operation of the machine 10F are consistent with the those of embodiments described hereinabove. Abrasive material is supplied from the hopper 14 to the blast wheel 26. The blast wheel 26 is rotated by the motor 30 to propel the abrasive material through the blast opening 22 and against the surface 16. The abrasive material rebounds from the surface 16 to the rebound corridor 24 and return corridor 52 and finally into the hopper 14 for reuse.

It should be appreciated that the trigger 82F and the trigger spring 162 may be utilized with any of the embodiments of hand-held blast machines described hereinabove. Moreover, it should be appreciated that the shoe 130, link member 138, shut-off plate 132 and biasing spring 152 construction may also be used with the trigger 82 or 82F in any of the embodiments described hereinabove.

Changes may be made in the combinations, operations and arrangements of the various parts and elements described herein without departing from the spirit and scope of the invention as defined in the following claims.

What is claimed is:

1. A hand-held apparatus for blast cleaning a surface, the apparatus comprising:

a housing having a blast corridor, a rebound corridor and a blast opening communicating with the blast corridor and the rebound corridor;

a blast wheel mounted within said housing, said blast wheel being adapted for rotating and propelling abrasive material through the blast corridor and blast opening against a surface to be cleaned;

a hopper attached to said housing and having a return corridor, said hopper communicating with the blast corridor to provide abrasive material to said blast wheel and the return corridor of said hopper communicating with the rebound corridor of said housing to receive spent abrasive material;

drive means for rotating said blast wheel, said drive means being sized and shaped to be hand-held by an operator of the apparatus;

a shut-off plate mounted within said housing and having a feed opening therethrough, said shut-off plate being pivotable between a shut-off position, wherein said shut-off plate keeps abrasive material from passing from said hopper to said blast wheel, and a feed position, wherein the feed opening of said shut-off plate allows abrasive material to pass from said hopper to said blast wheel;

a shoe mounted to said housing at the blast opening and being shaped to define a frame around the blast opening, said shoe being pivotable between a safety position, wherein at least a portion of said shoe protrudes from said housing beyond the blast opening, and an operating position, wherein the blast opening extends through the frame defined by said shoe;

a link member operatively connected to said shoe and said shut-off plate to dispose said shut-off plate in the shut-off position while said shoe is in the safety position and to dispose said shut-off plate in the feed position while said shoe is in the operating position; and means for biasing said shoe into the safety position;

wherein said shut-off plate is moved from the shut-off position into the feed position in response to placing said shoe against a surface to be blast cleaned and urging said housing to dispose the blast opening against the surface through the frame defined by said shoe.

2. A hand-held surface-cleaning apparatus convertible between side-blasting, down-blasting and up-blasting modes, the apparatus comprising:

a housing having a blast corridor, a rebound corridor and a blast opening communicating with the blast corridor and the rebound corridor;

a blast wheel rotatably mounted within said housing and adapted to propel abrasive material through the blast corridor and blast opening against a surface to be cleaned;

means for rotating said blast wheel;

three hoppers alternately attachable to said housing, each one of said hoppers having a return corridor communicating with the rebound corridor of said housing when attached to said housing, wherein a first one of said hoppers is adapted to feed abrasive material to said blast wheel when the blast opening is disposed in a generally lateral direction, a second one of said hoppers is adapted to feed abrasive material to said blast wheel when the blast opening is disposed in a generally downward direction, and a third one of said hoppers is adapted to feed abrasive material to said blast wheel when the blast opening is disposed in a generally upward direction;

a shut-off plate mounted within said housing and having a feed opening therethrough, said shut-off plate being pivotable between a shut-off position, wherein said shut-off plate keeps abrasive material from passing from said hopper to said blast wheel, and a feed position, wherein the feed opening of said shut-off plate allows abrasive material to pass from said hopper to said blast wheel;

a shoe mounted to said housing at the blast opening and being shaped to define a frame around the blast opening, said shoe being pivotable between a safety position, wherein at least a portion of said shoe protrudes from said housing beyond the blast opening, and an operating position, wherein the blast opening extends through the frame defined by said shoe;

a link member operatively connected to said shoe and said shut-off plate to dispose said shut-off plate in the shut-off position while said shoe is in the safety position and to dispose said shut-off plate in the feed position while said shoe is in the operating position; and means for biasing said shoe into the safety position;

wherein said shut-off plate is moved from the shut-off position into the feed position in response to placing said shoe against a surface to be blast cleaned and urging said housing to dispose the blast opening against the surface through the frame defined by said shoe.

3. A hand-held apparatus for blast-cleaning a surface, the apparatus comprising:

a housing having a blast corridor, a rebound corridor and a blast opening communicating with the blast corridor and the rebound corridor;

a blast wheel mounted within said housing, said blast wheel being adapted for rotating and propelling abrasive material through the blast corridor and blast opening against a surface to be cleaned;

a hopper attached to said housing and having a return corridor, said hopper communicating with the blast corridor to provide a gravity-fed supply of abrasive material to said blast wheel and the return corridor of said hopper communicating with the rebound corridor of said housing to receive spent abrasive material;

shut-off means for stopping the gravity-fed supply of abrasive material to the blast wheel unless said shut-off means is continuously actuated by an operator of the apparatus, the shut-off means comprising:

a trigger blade having a flow opening and a shut-off area, the trigger blade being pivotable between a shut-off position wherein the shut-off area of the trigger blade blocks communication between the hopper and the blast wheel and a feed position wherein the flow opening of the trigger blade establishes communication between the hopper and the blast corridor.

4. A hand-held apparatus for blast cleaning a surface, the apparatus comprising:

a housing having a blast corridor, a rebound corridor and a blast opening communicating with the blast corridor and the rebound corridor; a blast wheel mounted within said housing, said blast wheel being adapted for rotating and propelling abrasive material through the blast corridor and blast opening against a surface to be cleaned;

a hopper attached to said housing and having a return corridor, said hopper communicating with the blast corridor to provide abrasive material to said blast wheel and the return corridor of said hopper communicating with the rebound corridor of said housing to receive spent abrasive material;

a shoe mounted to said housing at the blast opening and being shaped to define a frame around the blast opening, said shoe being pivotable between a safety position, wherein at least a portion of said shoe protrudes from said housing beyond the blast opening, and an operating position, wherein the blast opening extends through the frame defined by said shoe;

a shut-off plate mounted within said housing, said shut-off plate having a feed opening therethrough, said shut-off plate being pivotable between a shut-off position, wherein said shut-off plate keeps abrasive material from passing from said hopper to said blast wheel, and a feed position, wherein the feed opening of said shut-off plate allows abrasive material to pass from said hopper to said blast wheel, said shut-off plate being connected to said shoe such that said shut-off plate is in the shut-off position when said shoe is in the safety position and such that said shut-off plate is in the feed position when said shoe is in the operating position; and means for biasing said shoe into the safety position and said shut-off plate into the shut-off position.

* * * * *